US010774407B2

(12) United States Patent
Manuel

(10) Patent No.: US 10,774,407 B2
(45) Date of Patent: Sep. 15, 2020

(54) NICKEL TITANIUM ALLOYS, METHODS OF MANUFACTURE THEREOF AND ARTICLE COMPRISING THE SAME

(71) Applicant: University of Florida Research Foundation, Inc., Gainesville, FL (US)

(72) Inventor: Michele Viola Manuel, Gainesville, FL (US)

(73) Assignee: University of Florida Research Foundation, Inc., Gainesville, FL (US)

( * ) Notice: Subject to any disclaimer, the term of this patent is extended or adjusted under 35 U.S.C. 154(b) by 322 days.

(21) Appl. No.: 15/737,339

(22) PCT Filed: Jun. 20, 2016

(86) PCT No.: PCT/US2016/038330

§ 371 (c)(1),
(2) Date: Dec. 18, 2017

(87) PCT Pub. No.: WO2016/205781

PCT Pub. Date: Dec. 22, 2016

(65) Prior Publication Data

US 2018/0179620 A1 Jun. 28, 2018

Related U.S. Application Data

(60) Provisional application No. 62/181,805, filed on Jun. 19, 2015.

(51) Int. Cl.

| | |
|---|---|
| ***C22C 30/04*** | (2006.01) |
| ***C22F 1/00*** | (2006.01) |
| ***C22F 1/10*** | (2006.01) |
| ***C22C 1/02*** | (2006.01) |

(52) U.S. Cl.
CPC ..... *C22F 1/006* (2013.01); *C22C 1/02* (2013.01); *C22C 30/04* (2013.01); *C22F 1/10* (2013.01)

(58) Field of Classification Search
None
See application file for complete search history.

(56) References Cited

U.S. PATENT DOCUMENTS

| | | | |
|---|---|---|---|
| 6,238,496 | B1 | 5/2001 | Akers et al. |
| 7,491,275 | B2 | 2/2009 | Cao et al. |

(Continued)

FOREIGN PATENT DOCUMENTS

| | | |
|---|---|---|
| EP | 0709482 | 5/1996 |
| EP | 1997922 | 12/2008 |

(Continued)

OTHER PUBLICATIONS

English Translation of JP 62-037353 (originally published Feb. 18, 1987) from J-Plat Pat.*

(Continued)

*Primary Examiner* — George Wyszomierski
(74) *Attorney, Agent, or Firm* — Thomas | Horstemeyer, LLP

(57) ABSTRACT

Disclosed herein is a shape memory alloy comprising 45 to 50 atomic percent nickel; and 1 to 30 atomic percent of at least one metalloid selected from the group consisting of germanium, antimony, zinc, gallium, tin, and a combination of one or more of the foregoing metalloids, with the remainder being titanium. The shape memory alloy may further contain aluminum. Disclosed herein too is a method of manufacturing the shape memory alloy.

15 Claims, 4 Drawing Sheets

Chemistry of Light Phase

| Element | Weight % | Atomic % |
|---|---|---|
| Sn L | | 27 |
| Ti K | | 26 |
| Ni K | | 47 |

(56) References Cited

U.S. PATENT DOCUMENTS

| | | | | |
|---|---|---|---|---|
| 7,749,341 | B2 | 7/2010 | Noebe et al. | |
| 8,007,604 | B2 | 8/2011 | Miyazaki et al. | |
| 8,475,711 | B2 | 7/2013 | Wojcik | |
| 2006/0184231 | A1 * | 8/2006 | Rucker | C22F 1/006 623/1.15 |
| 2008/0000556 | A1 | 1/2008 | Jung et al. | |
| 2012/0326097 | A1 | 12/2012 | Ren et al. | |
| 2014/0137991 | A1 | 5/2014 | Mitarai et al. | |

FOREIGN PATENT DOCUMENTS

| | | | | |
|---|---|---|---|---|
| JP | S58157934 | A | | 9/1983 |
| JP | 62037353 | A | * | 2/1987 |
| WO | 2016003627 | A2 | | 1/2016 |

OTHER PUBLICATIONS

Zou, et al., Fabrication and thermoelectric properties of fine-grained TiNiSn compounds, Journal of Solid Chemistry, 182, p. 3138-3142, 2009.

Chai, et al., Microstructure evolution of nanoprecipitates in half-Heusler TiNiSn alloys, Acta Materialia 61, p. 6684-6697, 2013.

International Search Report for PCT/US2016/038330 dated Sep. 14, 2016.

Hsu et al., "The effect of aluminum additions on the thermal, microstructural and mechanical behavior of NiTiHf shape memory alloys" Journal of Alloys and Compounds, vol. 638, pp. 67-76, (Feb. 20, 2015).

Figueroa et al., "Sn Additions to NiTi for Novel Shape Memory Alloy Desig" In: Integrative Materials Design II: Performance and Sustainability: Advanced Manufacturing Technologies: Processing, Structure, Properties, and Design. The Minerals, Metals & Materials Society (TMS) 144th Annual Meeting & Exhibition, Orlando, Mar. 16, 2015, retrieved on Aug. 19, 2016, http://ww.programmaster.org/PM/PM.nsfNiewSessionSheets?OpenAgent&ParentUNID=622411EFCB81E0C185257D3C0075C6F8>.

TMS, "144th Annual Meeting & Exhibition Final Program" (Feb. 23, 2015) [online] [retrieved on Aug. 19, 2016). Retrieved from the Internet <URL: http://www.tms.org/meetings/annual-15/downloads/AM15Fina1Program.pdf> p. 120.

* cited by examiner

Phase Identification of 50Ni-25Ti-25X at% *nominal*

Bulk Chemistry

| Element | Weight % | Atomic % |
|---|---|---|
| Sb L | 40.3 | 23.5 |
| Ti K | 16.0 | 23.8 |
| Ni K | 43.7 | 52.7 |

Bulk Chemistry

| Element | Weight % | Atomic % |
|---|---|---|
| Ga L | 33.8 | 28.8 |
| Ti K | 18.8 | 22.5 |
| Ni K | 48.1 | 48.7 |

Chemistry of Light Phase

| Element | Weight % | Atomic % |
|---|---|---|
| Sn L | | 27 |
| Ti K | | 26 |
| Ni K | | 47 |

Phase Identification of 50Ni-25Ti-25X at% *nominal*

Thermal Analysis

Mechanical Testing

NICKEL TITANIUM ALLOYS, METHODS OF MANUFACTURE THEREOF AND ARTICLE COMPRISING THE SAME

CROSS-REFERENCE TO RELATED APPLICATION

This application is the 35 U.S.C. § 371 national stage application of PCT Application No. PCT/US2016/038330, filed Jun. 20, 2016, where the PCT claims priority to U.S. Provisional application No. 62/181,805 filed Jun. 19, 2015, both of which are herein incorporated by reference in their entireties.

STATEMENT REGARDING FEDERALLY SPONSORED RESEARCH

This invention was made with Government support under Grant Number NNX12AQ42G awarded by NASA. The government has rights in the invention.

BACKGROUND

This technology addresses an ever-increasing need for shape memory alloys (SMAs) in aerospace, automotive and power generation industries. The shape-memory effect is caused by a thermoelastic martensitic transformation—a reversible transformation between two different crystalline microstructures that occurs when a shape-memory alloy (SMA) is heated or cooled. An SMA is deformed in the martensite condition, and the shape recovery occurs during heating when the specimen undergoes a reverse transformation of the martensite to the parent phase. Under constrained conditions, the output stress during reversion is limited by the flow strength of the parent phase. For engineering applications, it is also essential that the shape-memory behavior is repeatable and predictable after many cycles through the transformation.

Future potential applications for the newly developed high-temperature SMAs include shape-morphing structures, actuators and valves for airplanes and vehicles, and oil and gas exploration components. This innovation can be implemented into current aerospace applications including variable geometry chevron, variable area fan nozzle, and reconfigurable rotor blade that reduce noise and increase fuel economy by using high-temperature SMA actuators to adapt to changing flight conditions.

SUMMARY

Figure 1A:
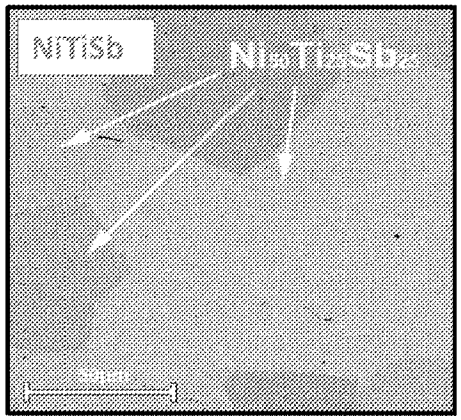
FIG. 1A shows a photomicrograph and a table that represents nickel titanium alloy that contain antimony, along with energy dispersive spectroscopy (EDS) analysis of the alloy.

Disclosed herein is a shape memory alloy comprising 45 to 50 atomic percent nickel and 1 to 30 atomic percent of at least one metalloid selected from the group consisting of germanium, antimony, zinc, gallium, tin, indium, bismuth and a combination of one or more of the foregoing metalloids with the remainder being titanium.

Disclosed herein is a shape memory alloy comprising aluminum, 45 to 50 atomic percent nickel and 1 to 30 atomic percent of at least one metalloid selected from the group consisting of germanium, antimony, zinc, gallium, tin, indium, bismuth and a combination of one or more of the foregoing metalloids, with the remainder being titanium.

Disclosed herein too is a method of manufacturing a shape memory alloy comprising mixing together to form an alloy nickel, at least one metalloid and titanium in amounts of 45 to 50 atomic percent nickel, 1 to 30 atomic percent of at least one metalloid selected from the group consisting of germanium, antimony, zinc, gallium, tin, indium, bismuth and a combination of one or more of the foregoing metalloids, with the remainder being titanium, solution treating the alloy at a temperature of 700 to 1300° C. for 50 to 200 hours; and optionally aging the alloy at a temperature of 400 to 900° C. for a time period of 50 to 200 hours to form a shape memory alloy.

Disclosed herein too is a method of manufacturing a shape memory alloy comprising mixing together to form an alloy, aluminum, at least one metalloid and titanium in amounts of 45 to 50 atomic percent nickel, 1 to 30 atomic percent of at least one metalloid selected from the group consisting of germanium, antimony, zinc, gallium, tin, indium, bismuth and a combination of one or more of the foregoing metalloids, with the remainder being titanium; with the remainder being titanium; solution treating the alloy at a temperature of 700 to 1300° C. for 50 to 200 hours; and optionally aging the alloy at a temperature of 400 to 900° C. for a time period of 50 to 200 hours to form a shape memory alloy.

DETAILED DESCRIPTION

A nickel-titanium-metalloid shape memory alloy (SMA), for example, a nickel-titanium-tin (NiTiSn) SMA, with the optimum Heusler precipitate size corresponding to peak aging conditions will demonstrate a longer fatigue life, improved strength and output stress, and increased transformation temperature, which demonstrates a significant improvement in properties and expansion in applications. This innovation provides a systems-approach that combines thermodynamic design with advanced characterization techniques to facilitate the accelerated development of precipitation-strengthened high-temperature SMAs and propel transformative advancement in this field. In regards to immediate impact, this technology will serve as a strong foundation for fundamental knowledge and design parameters on nickel-titanium-metalloid SMAs that other researchers can use to optimize alloys for commercial and industrial applications. In the future, the long-term vision is that this same design methodology can be applied to similar SMA systems, eventually enabling the generation of a database with SMAs of customizable mechanical properties and transformation temperatures adapted for specific applications.

This technology details a nickel-titanium (NiTi)-based, precipitation-strengthened, high-temperature shape memory alloy (SMA). The alloy microstructure comprises a nickel-titanium Ni—Ti matrix with a metalloid addition, strengthened by coherency between a NiTi phase and a Heusler phase, and a Heusler intermetallic phase. The metalloid addition to NiTi increases the specific strength and transformation temperatures. This addition results in increased alloy strength as well as high operating temperatures.

As used herein, the term "metalloid" refers to a chemical element with properties in between, or that are a mixture of, those of metals and nonmetals. Such elements are found in a diagonal region of the p-block of the Periodic Table of Chemical Elements extending from boron at one end to astatine at the other end. Examples of metalloids include, but are not limited to, boron, silicon, germanium, arsenic, antimony, tellurium, carbon, selenium, polonium, astatine, beryllium, phosphorus, sulfur, zinc, gallium, tin, iodine, lead, indium, and bismuth. Exemplary metalloids are gallium, tin and antimony, indium and bismuth.

In an embodiment, the at least one metalloid constituent is a combination of one of the foregoing metalloids and aluminum. In another exemplary embodiment, the metalloid comprises gallium, tin, or antimony, each of which may be combined with aluminum, nickel and titanium.

In an exemplary embodiment, the at least one metalloid is tin (Sn), gallium or antimony forming a Ni—Ti—Sn shape memory alloy or a Ni—Ti—Ga alloy or a Ni—Ti—Sb alloy respectively.

In one embodiment, the alloy is designed with a two-step heat treatment:

1) solution-treatment at a higher temperature to obtain a supersaturated Ni(Ti, metalloid) matrix, and
2) aging treatment at a lower temperature to precipitate the strengthening Heusler phase. This innovation encompasses a thermodynamically-driven systems approach to design the aforementioned SMAs that can be applied to different systems other than NiTi-based alloys.

The nickel-titanium-metalloid shape memory alloy comprises 45 to 50 atomic percent nickel (Ni), 1 to 30 atomic percent of at least one metalloid (M) selected from the group consisting of boron, silicon, germanium, arsenic, antimony, tellurium, carbon, selenium, polonium, astatine, hydrogen, beryllium, nitrogen, phosphorus, sulfur, zinc, gallium, tin, iodine, lead, indium, bismuth and radon, and a combination of one or more of the foregoing metalloids and aluminum, with the remainder being titanium (Ti). In an exemplary embodiment, the shape memory alloy has the formula $Ni_{50}Ti_{(50-x)}M_x$, where x can have a value of up to about 30 atomic percent, preferably up to 25 atomic percent, preferably up to 20 atomic percent, and preferably up to 10 atomic percent. In an embodiment, M is a metalloid selected from the group consisting of germanium, antimony, zinc, gallium, tin, indium, bismuth and a combination of one or more of the foregoing metalloids. In an embodiment, the number 'x' can have integer or non-integer values of from 1 to 30. In an embodiment, x has values of 1, 2, 3, 4, 5, 6, 7, 8, 9, 10, 11, 12, 13, 15, 17, 18, 19, 20, 21, 22, 23, 24, 25, 26, 27, 28, 29 and 30 atomic percent.

In another embodiment, the nickel-titanium-metalloid shape memory alloy comprises 3 to 7 atomic percent of the at least one metalloid. In yet another embodiment, the nickel-titanium-metalloid shape memory alloy comprises 1 to 5 atomic percent of the at least one metalloid. In yet another, embodiment, the nickel-titanium-metalloid shape memory alloy comprises 15 to 30 atomic percent of the at least one metalloid, preferably 17 to 28 atomic percent of at least one metalloid, and more preferably 20 to 25 atomic percent of at least one metalloid.

In an embodiment, the titanium is present in the nickel-titanium-metalloid shape memory in an amount of 40 to 50 atomic percent, specifically 45 to 50 atomic percent, more specifically 47 to 50 atomic percent.

For a solution-treated nickel-titanium-metalloid shape memory alloy having up to 30 weight percent (wt %) metalloid (based on the total weight of the nickel-titanium-metalloid shape memory alloy), the compressive strength values were 1,000 to 3,000 MPa, specifically 1,500 to 2,500 MPa, at approximately 1.5 to 5% compressive strain, specifically 2.5 to 4.5% compressive strain. During unloading the nickel-titanium-metalloid shape memory alloys having up to 2 wt % metalloid showed a residual strain of up to 5%, preferably up to 2%, preferably up to 1%, preferably up to 0.1% and more preferably up to 0.01%. The stress-strain behavior of these alloys under compressive stress indicates that they are in the austenite state at the start of testing. The Heusler precipitates have an average particle size of 1 to 100 nanometers, preferably 2 to 50 nanometers, and preferably 3 to 10 nanometers.

For the nickel-titanium-metalloid shape memory alloys having greater than 2 wt % metalloid and less than 5 wt % metalloid based on the total weight of the nickel-titanium-metalloid shape memory alloy, the stress-strain behavior is indicative of a transition state between the martensite and austenite phases at the testing temperature. For the 4 and 5 wt % metalloid alloys, the behavior confirms that the transformation temperatures of these alloys are below room temperature. It can also be concluded that precipitates formed during the aging process increased the strength of the alloys once the solubility limit of approximately 8% metalloid has been reached. Both Heusler and Han phase precipitates that strengthen the alloy were observed in the 3, 4, and 5% metalloid alloy with precipitates sizes from 1 to 10 nm. Depending on the composition, transformation temperatures ranged from 315 to −150° C.

The alloy can be produced by taking powders of nickel, titanium, and the at least one metalloid in the desired proportions and induction melting them or arc melting them to produce the alloy. It can be solution treated to obtain a supersaturated matrix. The alloy is solution treated (or alternatively annealed) at a temperature of 700 to 1300° C., specifically 800 to 1050° C. for 50 to 200 hours, specifically 75 to 150 hours. In an exemplary embodiment, the alloy was solution treated at a temperature of 700° C. to 1050° C. for 40 to 60 hours.

The alloy is then optionally aged at 400 to 900° C., specifically 550 to 650° C. for a time period of 50 to 200 hours, specifically 75 to 125 hours to form the shape memory alloy.

The shape memory alloy was characterized using differential scanning calorimetry, optical microscopy, xray diffraction, compression testing and transmission electron microscopy.

EXAMPLE

This example was conducted to demonstrate the properties of nickel-titanium (NiTi) alloys that contain either antimony, gallium, tin, indium or bismuth. The antimony, gallium, tin, indium or bismuth are added in amounts of about 25 atomic percent to the alloy. NiTi-based alloys were fabricated via vacuum arc-melting to make 8 gram buttons, and took place on a water cooled, copper crucible.

Elements used include Ni with a purity of 99.99%, Ti with a purity of 99.99%, Ga with a purity of 99.99%, Sb with a purity of 99.999%, Sn with a purity of 99.9%, In with a purity of 99.9%, and Bi with a purity of 99.99%. Buttons were melted and flipped five times in order to ensure homogeneity, and then heat treated in vacuum encapsulated quartz tubes at 800° C. and 1050° C. respectively for 50 hours. Specimens were quenched in water, and then sectioned and polished using Allied silicon-carbide grinding paper from 320, 600, 800, and 1200. After grinding, specimens were polished in a Buehler liquid suspension of alumina at 1 and 0.5 microns. Microstructural and chemical analysis was achieved using scanning electron microscopy (SEM) and energy dispersive spectroscopy (EDS) in a TESCAN MIRA3 system. Structural properties were analyzed using a Panalytical) (Pert Powder x-ray diffraction (XRD) instrument. Mechanical compression testing was done on a Instron 5582 loading frame at a strain rate of 1%/min on cylindrical compression samples which were fabricated using a wire EDM technique. Finally, differential scanning calorimetry (DSC) was completed with a PerkinElmer DSC 8000 Differential Scanning calorimeter from −50° C. to 300° C. at a rate of 10° C./min.

Figure 1B:
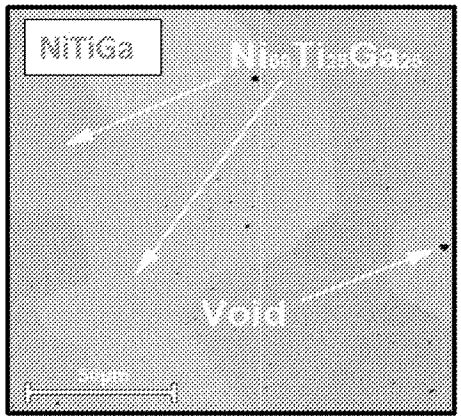
FIG. 1B shows a photomicrograph and a table that represents nickel titanium alloy that contain gallium, along with energy dispersive spectroscopy (EDS) analysis of the alloy.
Figure 1C:
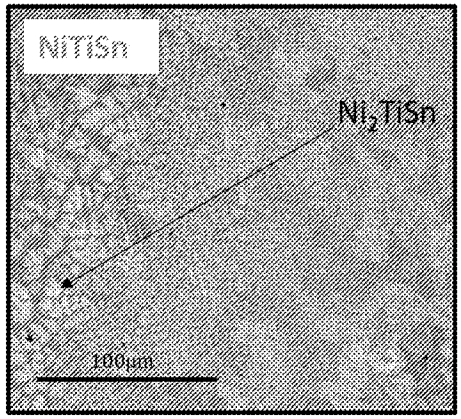
FIG. 1C shows a photomicrograph and a table that represents nickel titanium alloy that contain tin, along with energy dispersive spectroscopy (EDS) analysis of the alloy.

FIG. 1A-1C show photomicrographs and tables of phases that exemplify Heusler precipitates. FIG. 1A shows a photomicrograph and a table that represents nickel titanium alloys that contain antimony. FIG. 1B shows a photomicrograph and a table that represents nickel titanium alloys that contain gallium. FIG. 1C shows a photomicrograph and a table that represents nickel titanium alloys that contain tin. While the initial amount of nickel in the nickel titanium alloy is 50 atomic percent, the initial amount of titanium in the nickel titanium alloy is 25 atomic percent, and the initial amount of either antimony, gallium or tin is 25 atomic percent, the final amounts of the respective elements are different.

FIG. 1A shows a table that represents nickel titanium alloys that contains antimony (after annealing), where the amount of nickel is 48 to 53 atomic percent, preferably 51 to 53 atomic percent; where the amount of titanium is 23 to 25 atomic percent, preferably 23.5 to 24.0 atomic percent; and the amount of antimony is 23 to 24.5 atomic percent, preferably 23.2 atomic percent to 24.0 atomic percent.

FIG. 1B shows a table that represents nickel titanium alloys that contains gallium (after annealing), where the amount of nickel is 48 to 53 atomic percent, preferably 48 to 49.5 atomic percent; where the amount of titanium is 22 to 24 atomic percent, preferably 22.2 to 23.0 atomic percent; and the amount of gallium is 28 to 30 atomic percent, preferably 28.5 to 29.0 atomic percent.

FIG. 1C shows a table that represents nickel titanium alloys that contains tin (after annealing), where the amount of nickel is 46 to 51 atomic percent, preferably 47 to 48.5 atomic percent; where the amount of titanium is 25 to 28 atomic percent, preferably 25.2 to 26.3 atomic percent; and the amount of tin is 26 to 29 atomic percent, preferably 26.5 to 27.5 atomic percent.

Figure 2A:
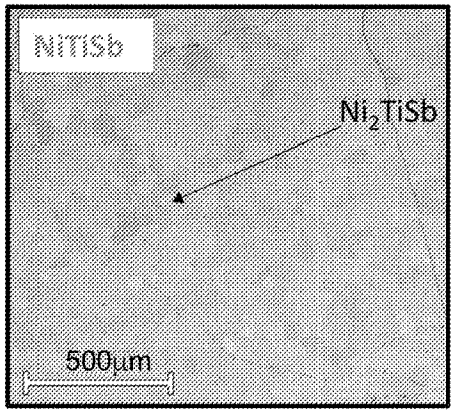
FIG. 2A shows a photomicrograph of nickel-titanium alloys that contain antimony along with x-ray diffraction (XRD) of the alloy.
Figure 2A:
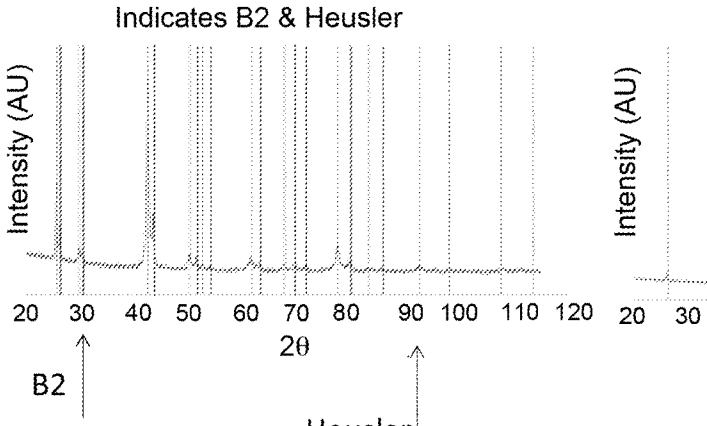
Figure 2B:
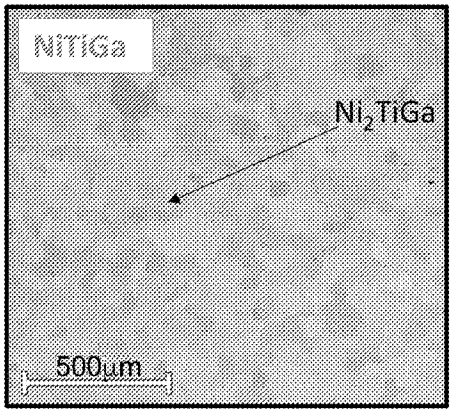
FIG. 2B shows a photomicrograph of nickel-titanium alloy that contain gallium along with x-ray diffraction (XRD) of the alloy.
Figure 2B:
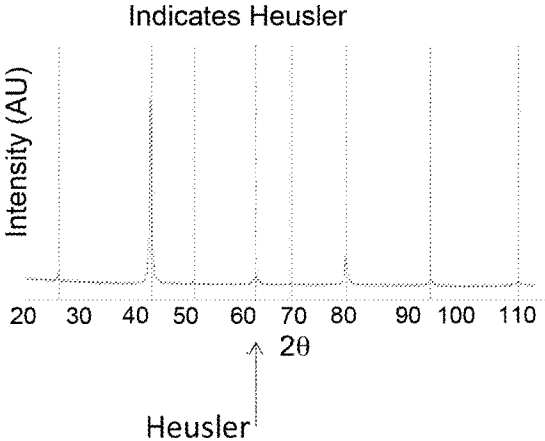
Figure 2C:
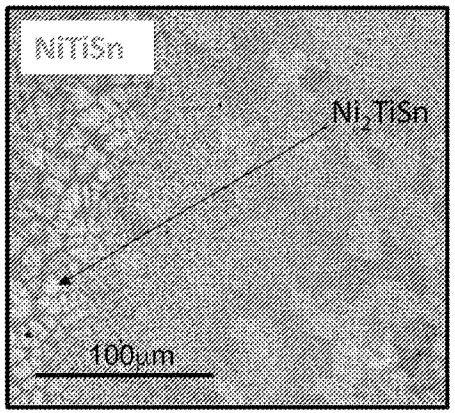
FIG. 2C shows a photomicrograph of nickel-titanium alloy that contain tin along with. with x-ray diffraction (XRD) of the alloy.
Figure 2C:
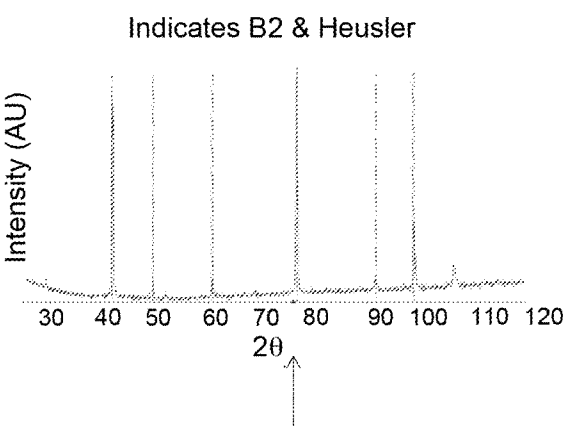

FIG. 2A shows a photomicrograph of nickel-titanium alloys that contain antimony along with x-ray diffraction (XRD) analysis of the alloy. The XRD analysis shows the presence of a B2 phase (which is a shape memory phase) and Heusler phases. FIG. 2B shows a photomicrograph of nickel-titanium alloys that contain gallium along with x-ray diffraction (XRD) analysis of the alloy. The XRD analysis shows the presence of only Heusler phases. FIG. 2C shows a photomicrograph of nickel-titanium alloys that contain tin along with x-ray diffraction (XRD) analysis of the alloy. The XRD analysis shows the presence of B2 and Heusler phases.

Figure 3:
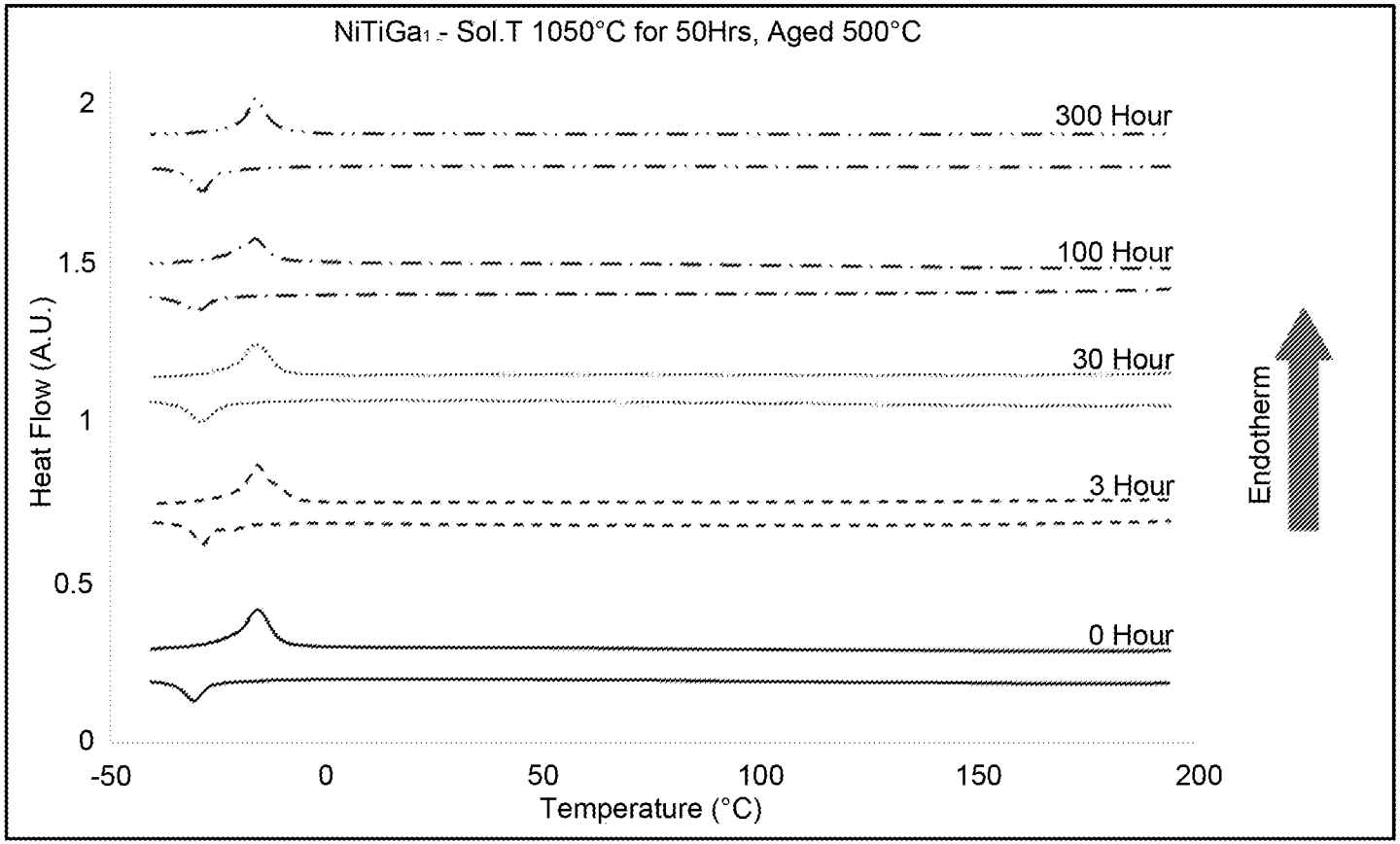
FIG. 3 depicts differential scanning calorimetry scans of nickel-titanium alloys that contain gallium when solution annealed and aged for time periods that range from 0 to 300 hours. The data shows that the martensite to austenite transition which indicates the shape memory effort.

FIG. 3 graphically depicts differential scanning calorimetry scans of nickel-titanium alloys that contain gallium when solution annealed for time periods that range from 0 to 300 hours. The atomic ratio of nickel to titanium to gallium is 2:1:1. The data shows that the martensite to austenite transition indicating the presences of shape memory behavior at various annealing times.

Figure 4:
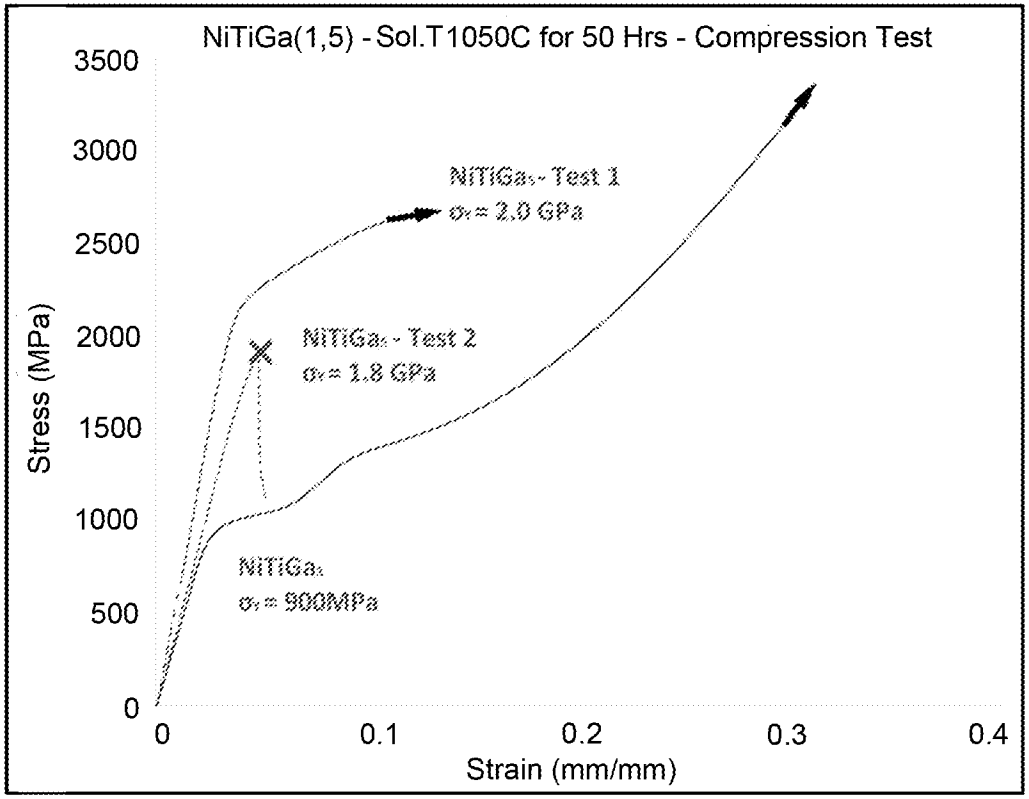
FIG. 4 is a graph that shows stress-strain data obtained from compression testing of two different nickel titanium alloys that contain gallium.

FIG. 4 is a graph that shows stress-strain data obtained from compression testing of two different nickel titanium alloys that contain gallium. There were two alloys tested—one that contains an atomic ratio of nickel to titanium to gallium of 2:1:1 and the other that contains an atomic ratio of nickel to titanium to gallium of 2:1:5. The sample containing nickel, titanium and gallium in an atomic ratio of 2:1:1 displays a much greater ability to withstand compression.

The invention claimed is:

1. A shape memory alloy comprising:

45 to 50 atomic percent nickel; and 10 to 30 atomic percent of at least one metalloid selected from the group consisting of germanium, antimony, zinc, gallium, tin, indium, bismuth, and a combination of one or more of the foregoing metalloids, with the remainder being titanium.

2. The shape memory alloy of claim 1, where the at least one metalloid is antimony, gallium or tin.

3. The shape memory alloy of claim 1, where the shape memory alloy has the formula $Ni_{50}\ Ti_{(50-x)}M_x$, where M is the at least one metalloid and x is from 10 to 30.

4. The shape memory alloy of claim 1, wherein the metalloid is from 20 to 30 atomic percent.

5. The shape memory alloy of claim 1, where the titanium is present in an amount of 45 atomic percent.

6. The shape memory alloy of claim 1, where the alloy displays a compressive strength of 1,000 to 3,000 MPa at a compressive strain of 1.5 to 5%.

7. The shape memory alloy of claim 1, where the alloy has precipitates that have an average particle size of 1 to 100 nanometers.

8. The shape memory alloy of claim 1, where the alloy further comprises aluminum.

9. The shape memory alloy of claim 1, where the at least one metalloid is antimony, gallium or tin in an amount of 20 to 30 atomic percent.

10. The shape memory alloy of claim 1, where the at least one metalloid is tin in an amount of 20 to 30 atomic percent.

11. A method of manufacturing a shape memory alloy according to claim 1, the method comprising:

mixing together to form an alloy nickel, at least one metalloid and titanium in amounts of 45 to 50 atomic percent nickel, 10 to 30 atomic percent of at least one metalloid selected from the group consisting of germanium, antimony, zinc, gallium, tin, indium, bismuth, and a combination of one or more of the foregoing metalloids, with the remainder being titanium; and solution treating the alloy at a temperature of 700 to 1300° C. for 50 to 200 hours.

12. The method of claim 11, further comprising aging the alloy at a temperature of 400 to 900° C. for a time period of 50 to 200 hours to form a shape memory alloy.

13. The method of claim 12, where the solution treating is conducted at 950° C. for 100 hours.

14. The method of claim 12, where the aging the alloy is conducted at 600° C. for 100 hours.

15. The method of claim 11, further comprising adding aluminum during the mixing.

* * * * *